US009488343B2

(12) United States Patent
Kaner

(10) Patent No.: US 9,488,343 B2
(45) Date of Patent: Nov. 8, 2016

(54) INTERCHANGEABLE LIGHTING ASSEMBLY

(71) Applicant: Mark Kaner, Wildwood, MO (US)

(72) Inventor: Mark Kaner, Wildwood, MO (US)

( * ) Notice: Subject to any disclaimer, the term of this patent is extended or adjusted under 35 U.S.C. 154(b) by 489 days.

(21) Appl. No.: 14/038,955

(22) Filed: Sep. 27, 2013

(65) Prior Publication Data

US 2015/0092423 A1 Apr. 2, 2015

(51) Int. Cl.

| | |
|---|---|
| ***F21V 17/00*** | (2006.01) |
| ***F21V 1/00*** | (2006.01) |
| *F21W 121/00* | (2006.01) |
| *F21Y 101/00* | (2016.01) |

(52) U.S. Cl.

CPC ..... *F21V 17/002* (2013.01); *F21V 1/00* (2013.01); *F21W 2121/00* (2013.01); *F21Y 2101/00* (2013.01); *F21Y 2113/10* (2016.08); *F21Y 2113/20* (2016.08)

(58) Field of Classification Search

CPC ..... F21V 17/002; F21V 1/00; F21V 17/06; F21V 17/04

See application file for complete search history.

(56) References Cited

U.S. PATENT DOCUMENTS

| | | | | |
|---|---|---|---|---|
| 5,825,637 | A * | 10/1998 | Chen | F21S 6/003 362/302 |
| 6,647,651 | B2 * | 11/2003 | Cutright | G09F 19/12 40/431 |
| D585,583 | S * | 1/2009 | Campbell | D26/118 |
| 7,806,568 | B2 | 10/2010 | Nielson | |
| 7,922,351 | B2 | 4/2011 | Welker | |
| 8,297,803 | B2 * | 10/2012 | Chen | F21V 1/02 362/330 |
| 8,596,833 | B1 * | 12/2013 | Cytrynowicz | F21V 1/16 156/218 |
| 2003/0107896 | A1 * | 6/2003 | Chu | F21V 1/06 362/356 |
| 2003/0142498 | A1 * | 7/2003 | Lu | F21V 1/06 362/352 |
| 2004/0070980 | A1 * | 4/2004 | Yang | F21V 1/04 362/352 |
| 2004/0125604 | A1 * | 7/2004 | Yeh | F21V 1/06 362/352 |
| 2005/0073842 | A1 * | 4/2005 | Pape | F21V 17/02 362/277 |
| 2005/0105292 | A1 * | 5/2005 | Hsu | F21V 17/007 362/352 |
| 2005/0185410 | A1 * | 8/2005 | Liao | F21V 1/06 362/352 |
| 2005/0190565 | A1 * | 9/2005 | Juang | F21V 1/26 362/351 |
| 2005/0231960 | A1 * | 10/2005 | Li | F21V 17/007 362/352 |
| 2006/0109659 | A1 * | 5/2006 | Lu | F21V 1/06 362/352 |
| 2006/0239012 | A1 * | 10/2006 | Bin | F21V 17/007 362/352 |
| 2008/0130297 | A1 * | 6/2008 | Hui | F21V 1/06 362/352 |
| 2012/0320577 | A1 | 12/2012 | Wang | |
| 2013/0201695 | A1 * | 8/2013 | Lewis | F21V 1/02 362/353 |

* cited by examiner

*Primary Examiner* — Anh Mai
*Assistant Examiner* — Zachary J Snyder
(74) *Attorney, Agent, or Firm* — David H. Chervitz

(57) ABSTRACT

An interchangeable lighting assembly is disclosed which comprises an inner plate member having depending leg portions each having an aperture for receiving a fastening device, an interchangeable cladding member having an aperture that is aligned with one of the apertures of one of the depending leg portions of the inner plate member, a fastening device for securing the interchangeable cladding member to the inner plate member through the aperture of the interchangeable cladding member aligned with the aperture of the depending leg portion, and a light source assembly connected to the inner plate member and depending therefrom.

20 Claims, 19 Drawing Sheets

INTERCHANGEABLE LIGHTING ASSEMBLY

BACKGROUND

This disclosure relates generally to a lighting fixture, and more particularly to a lighting fixture assembly that may have various interchangeable decorative outer housings to present different appearances.

Lighting fixtures are used to illuminate various areas. Lighting fixtures have a light source within a housing and are connected to a source of energy to operate the light source. Examples of light sources are incandescent bulbs, high intensity discharge (HID) bulbs, and light emitting diode (LED) devices. Each of these particular light sources requires different internal components to provide energy to operate the light source. For example, an LED device may include internal components such as an array of LEDs and a heat sink. In view of this, various different fixtures are required to accommodate the various light sources and their internal components.

Known lighting fixtures are selected and used by lighting designers, decorators, architects, and other individuals for various purposes. For example, a downlight lighting fixture is used to illuminate an area in a downward direction. A wall washer lighting fixture may be used to highlight or emphasize artwork hanging on a particular wall. A floodlight can be employed for general lighting of an area. As can be appreciated, the various known lighting fixtures may take on various appearances, structures, and constructions.

However, if it is decided to change a light fixture various problems ensue. One problem is that once a light fixture is mounted in place in order to remove the fixture the entire fixture must be removed. This will require that a completely new light fixture be used to replace the removed light fixture. Since the removed light fixture may still be fully operational and functional the removed light fixture will be wasted. Also, in removing the light fixture, the surrounding area, such as drywall, painted surfaces, and textured surfaces, may be damaged. This will require additional labor, time, and expense in repairing the damaged areas. Further, an electrician will be required to safely remove the existing light fixture and wire the new light fixture. In view of this, if a change in the appearance of an existing light fixture is desired, due to the various problems in removing an existing lighting fixture, the lighting designer, decorator, architect, or individual may decide to forgo the change.

It would therefore be desirable to have a lighting fixture that can accommodate various different decorative outer housings to be able to change the decorative outer housings without having to remove an existing lighting fixture or to completely disassemble the lighting fixture. The present disclosure is designed to obviate and overcome many of the disadvantages and shortcomings experienced with prior lighting fixtures. Moreover, the present disclosure is related to an interchangeable lighting assembly that can be used to change various decorative outer housings to present various different looking lighting fixtures as may be desired. The interchangeable lighting assembly of the present disclosure is also simple to assemble and disassemble in order to change various decorative outer housings that may be used with the assembly.

SUMMARY

In one form of the present disclosure, an interchangeable lighting assembly is disclosed which comprises an inner plate member having depending leg portions each having an aperture for receiving a fastening device, an interchangeable cladding member having an aperture that is aligned with one of the apertures of one of the depending leg portions of the inner plate member, a fastening device for securing the interchangeable cladding member to the inner ring member through the aperture of the interchangeable cladding member aligned with the aperture of the depending leg portion, and a light source assembly connected to the inner plate member and depending therefrom.

In another form of the present disclosure, an interchangeable lighting assembly comprises an inner plate member having depending leg portions each having an aperture for receiving a fastening device, an inner cladding member having apertures each aligned with each of the apertures of the leg portions, an interchangeable cladding member having apertures each aligned with each of the apertures of the inner cladding member and the leg portions, a fastening device for insertion into each of the aligned apertures for securing the interchangeable cladding member to the inner cladding member and the inner plate member, an outer ring member connected to the inner plate member for capping the assembly, and a light source assembly connected to the inner plate member and depending therefrom.

In still another form of the present disclosure, an interchangeable lighting assembly comprises an inner plate member having depending leg portions each having an aperture for receiving a fastening device, an interchangeable cladding member having apertures each aligned with each of the apertures of the leg portions, a fastening device for insertion into each of the aligned apertures for securing the interchangeable cladding member to the inner plate member, and a light source assembly connected to the inner plate member and depending therefrom.

In light of the foregoing comments, it will be recognized that the interchangeable lighting assembly of the present disclosure is of simple construction and design and which can be easily employed with highly reliable results.

The present disclosure provides an interchangeable lighting assembly in which various decorative outer housings may be attached to present various different appearances.

The present disclosure provides an interchangeable lighting assembly that can be easily assembled and disassembled.

The present disclosure provides an interchangeable lighting assembly that does not require removal of the interchangeable lighting assembly to change the appearance of the assembly.

The present disclosure also provides an interchangeable lighting assembly that is reconfigurable and does not require an electrician or other skilled technician.

The present disclosure provides an interchangeable lighting assembly that is reconfigurable and does not require any special tools or equipment to change the appearance of the assembly.

The present disclosure further provides an interchangeable lighting assembly that is reconfigurable and does not require removal from a power source in order to reconfigure the assembly.

The present disclosure provides an interchangeable lighting assembly that can be constructed using readily available materials and parts.

The present disclosure also provides an interchangeable lighting assembly that has numerous decorative outer housings that may be easily changed to provide various different configurations or appearances as desired.

The present disclosure further provides an interchangeable lighting assembly that allows easy access to a light source assembly positioned within the interchangeable lighting assembly to be able to change the light source assembly if required.

These and other advantages of the present disclosure will become apparent after considering the following detailed specification in conjunction with the accompanying drawings, wherein:

DETAILED DESCRIPTION OF THE PREFERRED EMBODIMENTS

Figure 1:
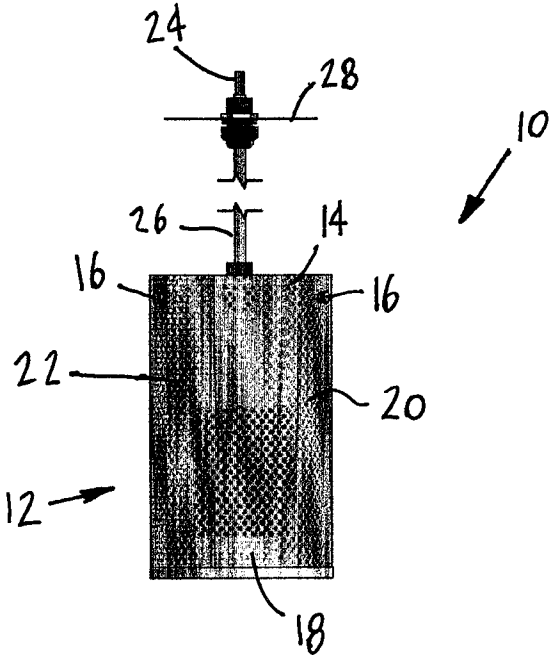
FIG. 1 is a perspective view of an interchangeable lighting assembly constructed according to the present disclosure.

Referring now to the drawings, wherein like numbers refer to like items, number 10 identifies a preferred embodiment of an interchangeable lighting assembly constructed according to the present disclosure. Referring now to FIG. 1, the interchangeable lighting assembly 10 is shown to comprise an interchangeable cladding member 12 that is attached to an inner plate member 14 by use of a fastening device such as set screws or thumb screws 16, and a light source assembly 18. In this particular view, the interchangeable cladding member 12 has perforations 20 that allow a view of an interior 22 of the device 10. The device 10 is connected to a source of electricity (not shown) by wiring 24. The wiring 24 is provided through a conduit 26 that is connected to the light source assembly 18. As can be appreciated, electricity or power is provided to the light source assembly 18 through the wiring 24. A plate 28 is provided for securing the plate 28 to an electrical box (not shown). Further, as will be explained in detail further herein, the interchangeable cladding member 12 may be removed from the device 10 by unscrewing the screws 16 and another interchangeable cladding member may be secured to the device 10 by use of the screws 16. In this manner, different interchangeable cladding members may be installed on the device 10 to present a different look or appearance of the device 10.

Figure 2:
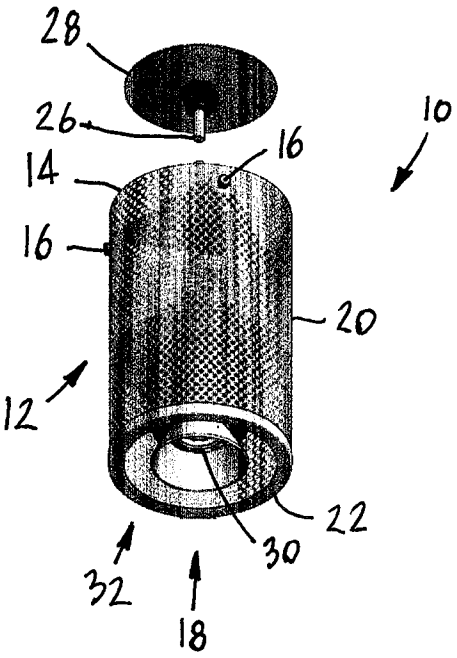
FIG. 2 is a side perspective view of the interchangeable lighting assembly constructed according to the present disclosure.

Referring now to FIG. 2, a side perspective view of the interchangeable lighting assembly 10 is shown. The interchangeable lighting assembly 10 is illustrated having the interchangeable cladding member 12 that is attached to the inner plate member 14 by use of the screws 16, and the light source assembly 18 depending from member 14 within the interior 22 of the cladding member 12. The light source assembly 18 has an LED light source or array 30 positioned at a bottom 32 of the cladding member 12. Although the LED light source 30 has been shown and described, it is also possible that a different light source be incorporated within the assembly 10. By way of example only, other light sources may be incandescent bulbs, fluorescent bulbs, or HID bulbs. The cladding member 12 also has a ring 34 that holds the cladding member 12 in a cylindrical shape. The cladding member 12 may also incorporate light emitting diodes to provide a glowing appearance. Also, the light emitting diodes may comprise different colors to provide a multicolor appearance.

Figure 3:
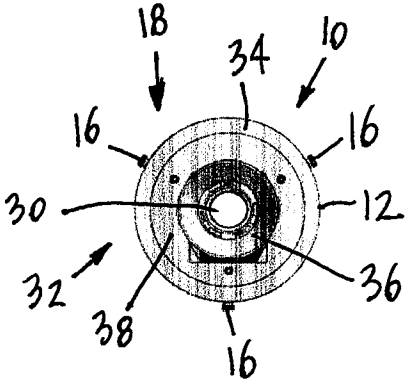
FIG. 3 is a bottom view of the interchangeable lighting assembly constructed according to the present disclosure.

FIG. 3 shows a bottom view of the interchangeable lighting assembly 10. The interchangeable lighting assembly 10 is shown having the LED light source 30 being positioned within a reflector 36. A plate member 38 is used to connect the light source assembly 18 to the inner plate member 14, as will be explained in more detail herein. The ring 34 that is used to hold the cladding member 12 in position is shown at the bottom 32 of the cladding member 12. The screws 16 are also shown being secured to hold the cladding member 12 in place. In this particular embodiment, three screws 16 are shown being used to secure the cladding member 12 in place. This is due to the triangular configuration and shape of the inner plate member 14 (not shown in this view). Depending upon the configuration and shape of the inner plate member 14, it is possible that more or less fastening devices 16 may be required to secure the interchangeable cladding member 12 in place.

Figure 4:
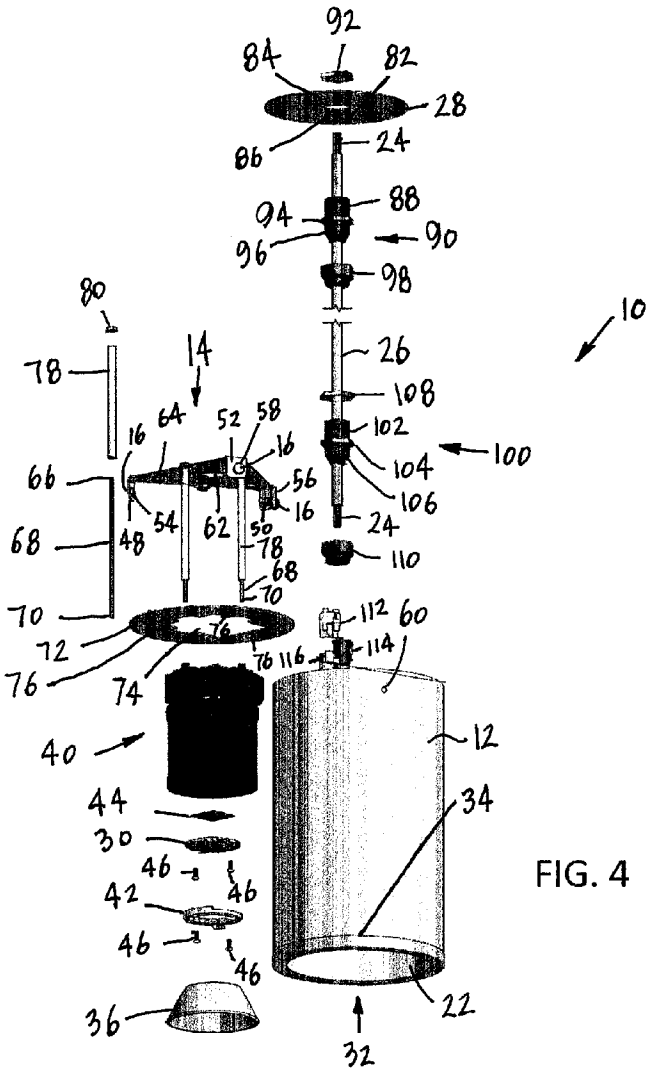
FIG. 4 is an exploded view of the interchangeable lighting assembly constructed according to the present disclosure.

With reference now to FIG. 4, an exploded view of the interchangeable lighting assembly 10 is depicted. The interchangeable lighting assembly 10 has the lighting assembly 18 which comprises a heat sink assembly 40, the reflector 36, a lamp holder clamp member 42, the LED light source 30, a piece of thermal tape 44, and various screws 46 for securing the LED light source 30 and the member 42 to the assembly 40. The inner plate member 14 is generally triangular in shape and has depending leg portions 48, 50, and 52 with each leg portion 48, 50, and 52 having an aperture 54, 56, and 58, respectively. The leg portions 48, 50, and 52 fit within the cladding member 12 and the apertures 54, 56, and 58 are orientated to be aligned with apertures 60 formed in the cladding member 12, The apertures 54, 56, 58, and 60 are formed to receive the screws 16. Further, the apertures 54, 56, and 58 may have threads (not shown) formed therein for receiving and retaining the screws 16. Although the inner plate member 14 is shown being triangular in shape, it is possible and contemplated that other shapes may be used, such as, by way of example only, round, rectangular having rounded off corners, and hexagonal.

The inner plate member 14 has a central opening 62 through which the wiring 24 and the conduit 26 pass. The inner plate member 14 also has apertures 64 that are used to receive a first threaded end 66 of a rod 68. There are three rods 68 depicted in this embodiment. The rod 68 also has a second threaded end 70. A plate member 72 has a central opening 74 and apertures 76 formed therein with the apertures 76 for receiving the second threaded end 70 of each of the rods 68 there through. A spacer tube 78 is inserted over the rod 68 between the inner plate member 14 and the plate member 72. The second threaded end 70 is used to be threaded into threaded openings (not shown) associated with the heat sink assembly 40. In this manner, the heat sink assembly 40 is connected to the plate member 72 and the rods 68 connect the plate member 72 to the inner plate member 14. A nut 80 may be connected to each of the first threaded ends 66 to secure each of the rods 68 to the inner plate member 14. As can be appreciated, if the heat sink assembly 40 ever needs to be replaced, then the nuts 80 may be removed to release the heat sink assembly 40 from the inner plate member 14.

As previously discussed, the mounting plate 28 is attached to an electrical box (not shown) by use of screws (not shown) being inserted into apertures 82 and 84 formed in the mounting plate 28. The mounting plate 28 also has a central opening 86 through which the wires 24 are inserted and a first threaded end 88 of a first double threaded rod 90. The first threaded end 88 is inserted through the central opening 86 and a nut 92 is attached to the first threaded end 88 to secure the first rod 90 to the mounting plate 28. The first double threaded rod 90 also has a stop portion 94 and a second threaded end 96. The stop portion 94 is used to abut the first rod 90 up against the mounting plate 28. Another nut 98 is used to secure the rod 90 to the mounting plate 28. A second double threaded rod 100 is inserted over the conduit 26 and is used to secure the inner plate member 14 to the conduit 26. The second double threaded rod 100 has a first threaded end 102, a stop portion 104, and a second threaded end 106. The first threaded end 102 is secured in place against the inner plate member 14 by use of a nut 108. The second threaded end 106 is also secured in placed against the inner plate member 14 by use of another nut 110. Power plugs 112, 114, and 116 are provided to be connected to the wires 24 and to connections (not shown) within the light source assembly 18. In this manner, power is provided to the light source assembly 18 to illuminate the LED light source 30.

The interchangeable cladding member 12 is connected to the inner plate member 14 by use of the screws 16 being inserted through the apertures 60 formed in the cladding member 12 and into the apertures 54, 56, and 58 formed in the leg portions 48, 50, and 52 of the inner plate member 14. If a new cladding member 12 or a different looking cladding member needs to be installed on the device 10, then the screws 16 are removed and the cladding member 12 is moved downwardly from the inner plate member 14 and away from the light source assembly 18. The new cladding member may then be placed over the light source assembly 18, moved upwardly toward the inner plate member 14, and the apertures 60 are aligned with the apertures 54, 56, and 58. Once aligned, the screws 16 are inserted and tightened to secure the new cladding member in place.

Figure 5:
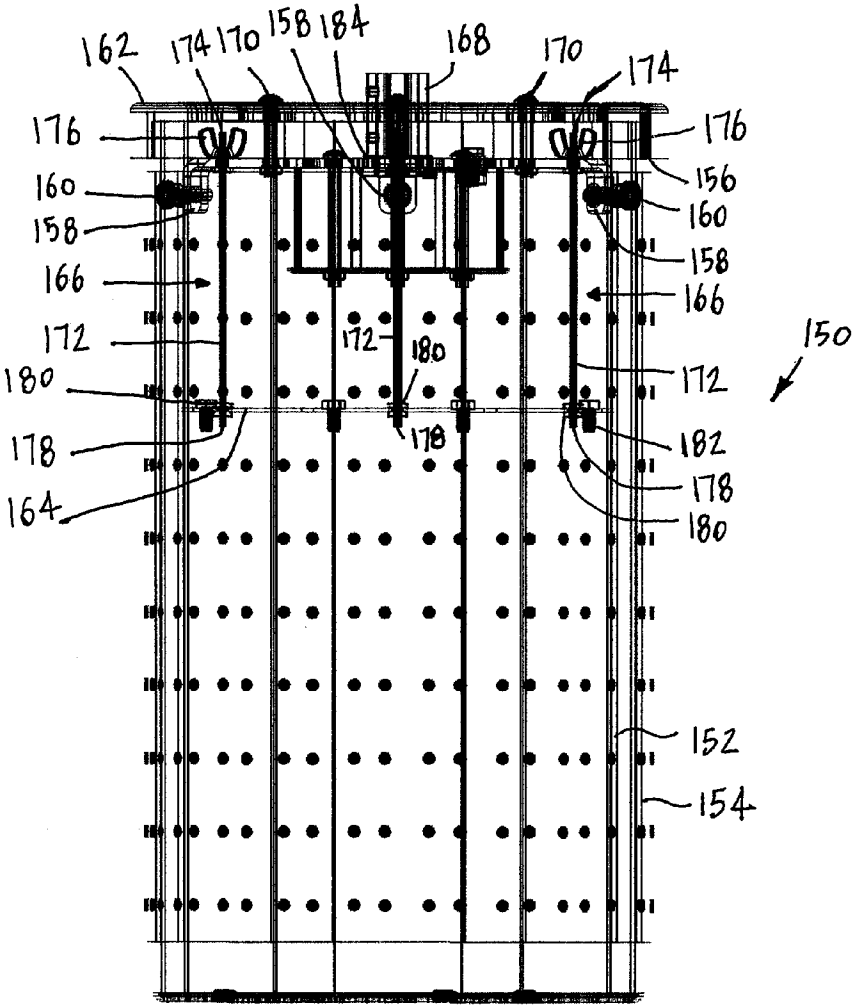
FIG. 5 is an enlarged perspective view of the interchangeable lighting assembly constructed according to the present disclosure.

FIG. 5 is a cross-sectional view of another embodiment of an interchangeable lighting assembly 150 constructed according to the present disclosure. The interchangeable lighting assembly 150 comprises an inner cladding member 152, an outer interchangeable cladding member 154, an inner plate member 156 having depending leg portions 158 each for receiving a fastening device such as a screw 160, an outer ring member 162 for capping the assembly 150, a plate member 164 for attaching a light source assembly (not shown), and connecting members 166 for connected the plate member 164 to the inner plate member 156. A conduit 168 is also provided for housing wiring (not shown) to supply electricity to the light source assembly. An example of the light source assembly is the light assembly 18. The outer interchangeable cladding member 154 may be removed from the device 150 by unscrewing the screws 160 and another interchangeable cladding member may be secured to the device 150 by use of the screws 160. In this manner, different interchangeable cladding members may be installed on the device 150 to present a different look or appearance of the device 150. Further, the cladding members 152 and 154 may include light emitting diodes such that the members 152 and 154 may provide a glowing appearance. The light emitting diodes may also comprise different colors to provide a multicolor appearance.

The outer ring member 162 is connected to the inner plate member 156 by use of fastening devices 170 such as screws or bolts. The connecting members 166 may comprise a threaded rod member 172 having an upper end 174 having a wing nut 176 threaded thereon to secure the rod member 172 to the inner plate member 156. The threaded rod member 172 also has a lower end 178 that has a fastening device 180 threaded thereon to secure the rod member 172 to the plate member 164. Other fastening devices 182 may be used to secure the light source assembly to the plate member 164. The inner plate member 156 is circular in shape having a central opening 184 for receiving the conduit 168. The circular shape of the inner plate member 156 allows the plate member 156 to fit within the inner cladding member 152.

Figure 6:
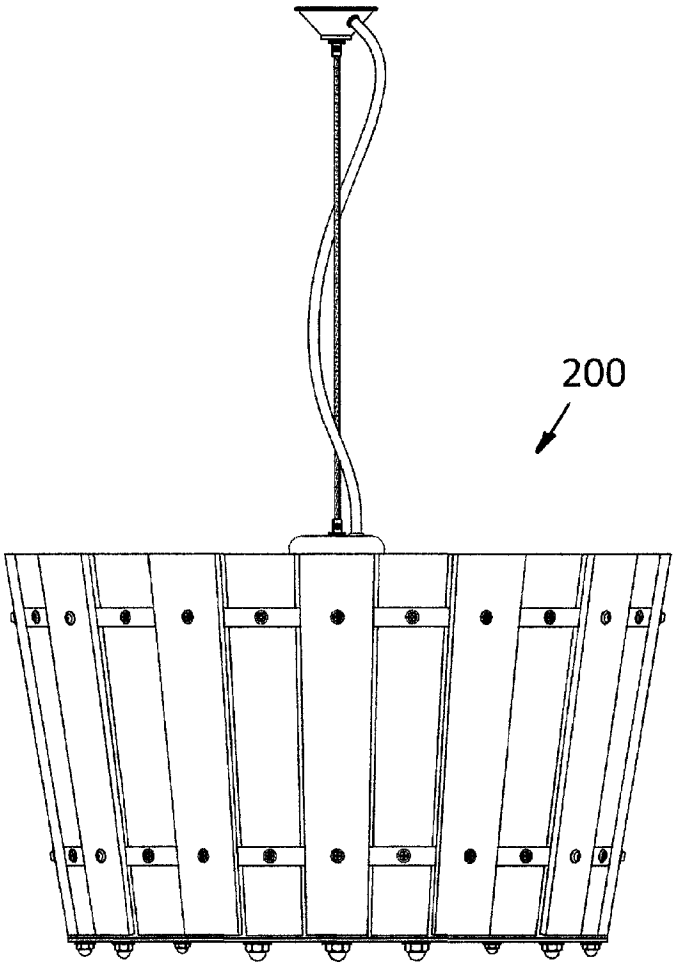
FIG. 6 is a perspective view of a basket type cladding connected to the interchangeable lighting assembly constructed according to the present disclosure.
Figure 7:
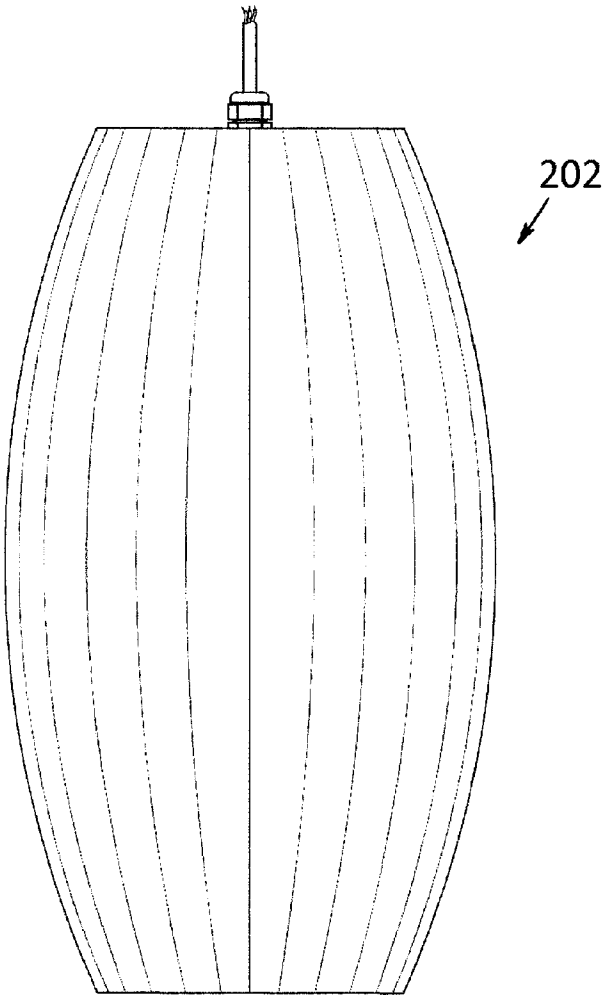
FIG. 7 is a perspective view of a cigar type cladding connected to the interchangeable lighting assembly constructed according to the present disclosure.
Figure 8:
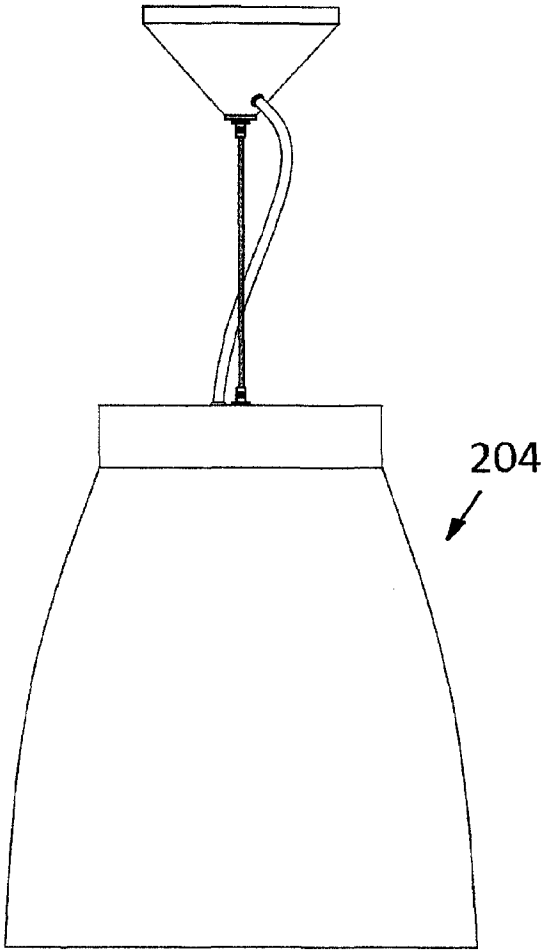
FIG. 8 is a perspective view of a vase type cladding connected to the interchangeable lighting assembly constructed according to the present disclosure.
Figure 9:
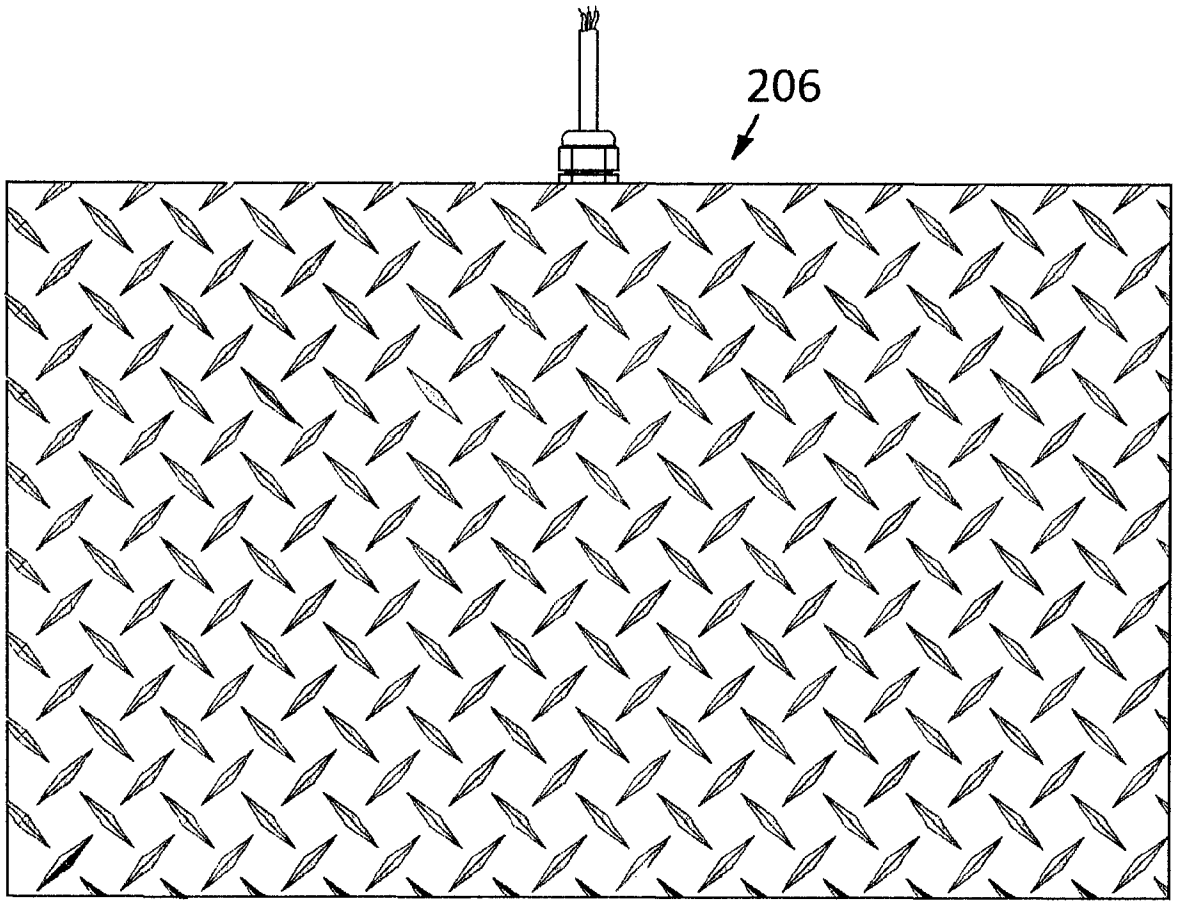
FIG. 9 is a perspective view of a diamond plate type cladding connected to the interchangeable lighting assembly constructed according to the present disclosure.
Figure 10:
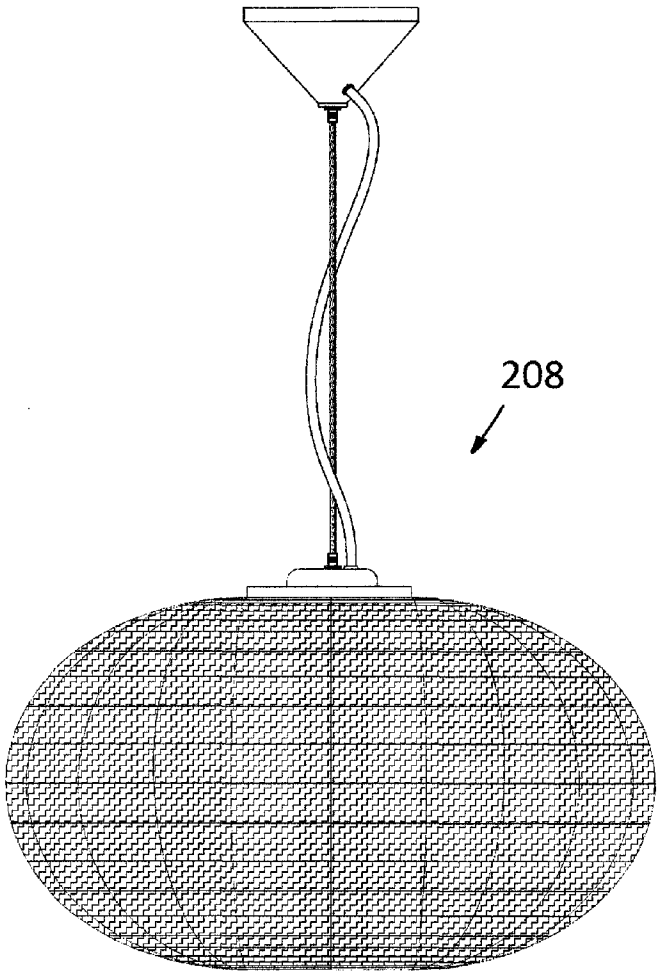
FIG. 10 is a perspective view of a globe type cladding connected to the interchangeable lighting assembly constructed according to the present disclosure.
Figure 11:
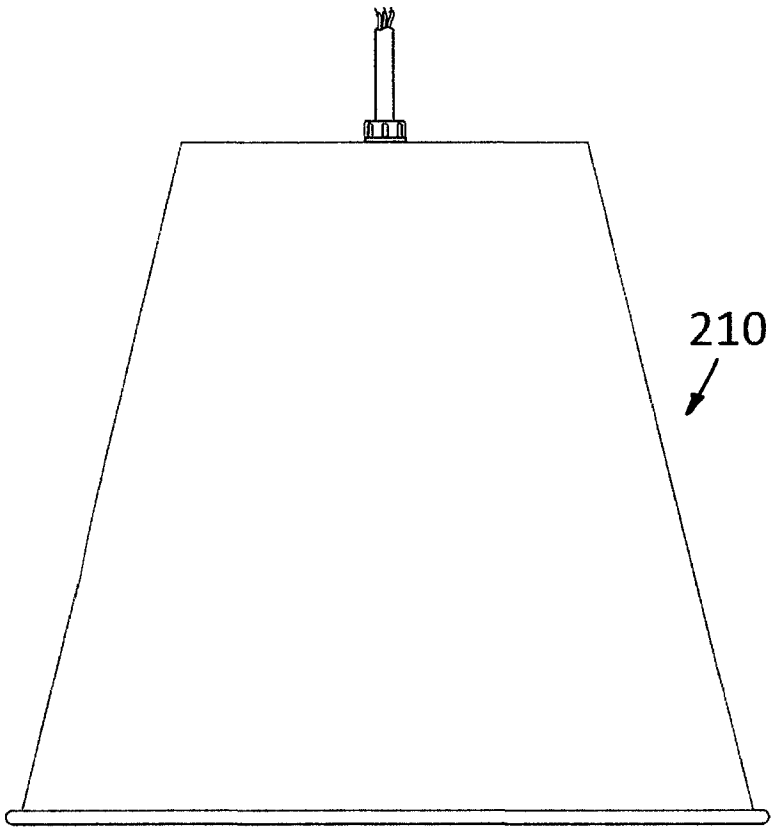
FIG. 11 is a perspective view of a hat type cladding connected to the interchangeable lighting assembly constructed according to the present disclosure.
Figure 12:
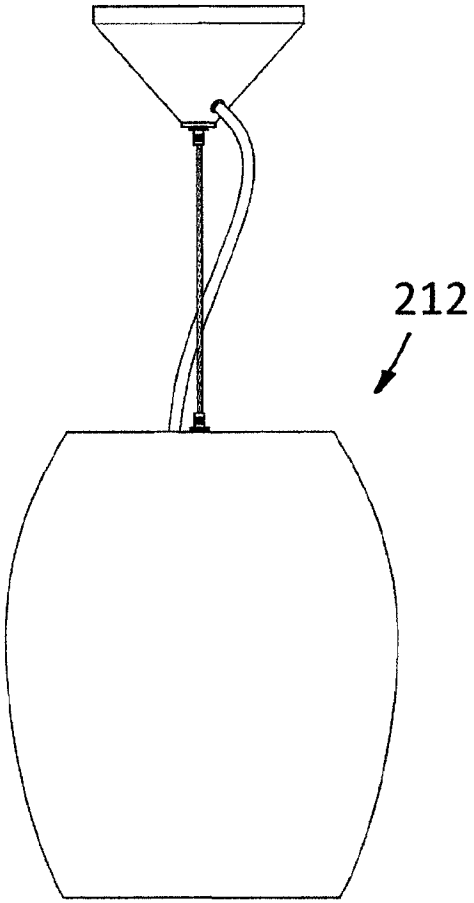
FIG. 12 is a perspective view of a flattened globe type cladding connected to the interchangeable lighting assembly constructed according to the present disclosure.
Figure 13:
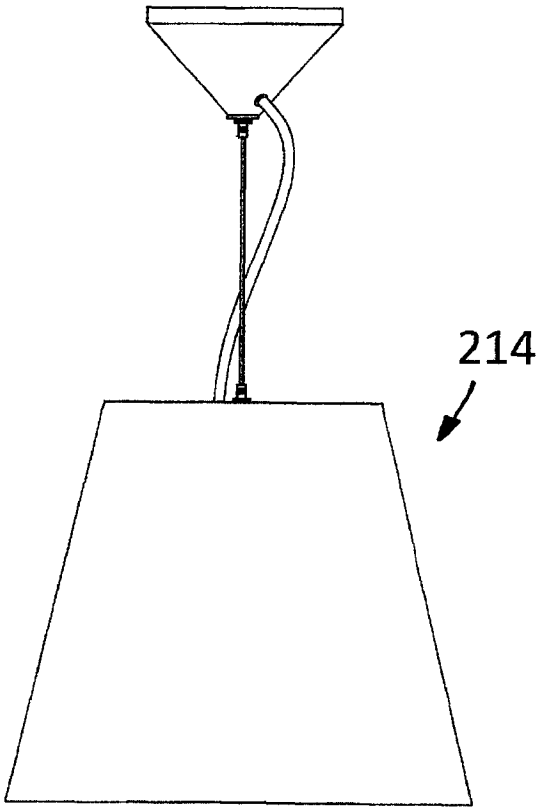
FIG. 13 is a perspective view of a truncated cone type cladding connected to the interchangeable lighting assembly constructed according to the present disclosure.
Figure 14:
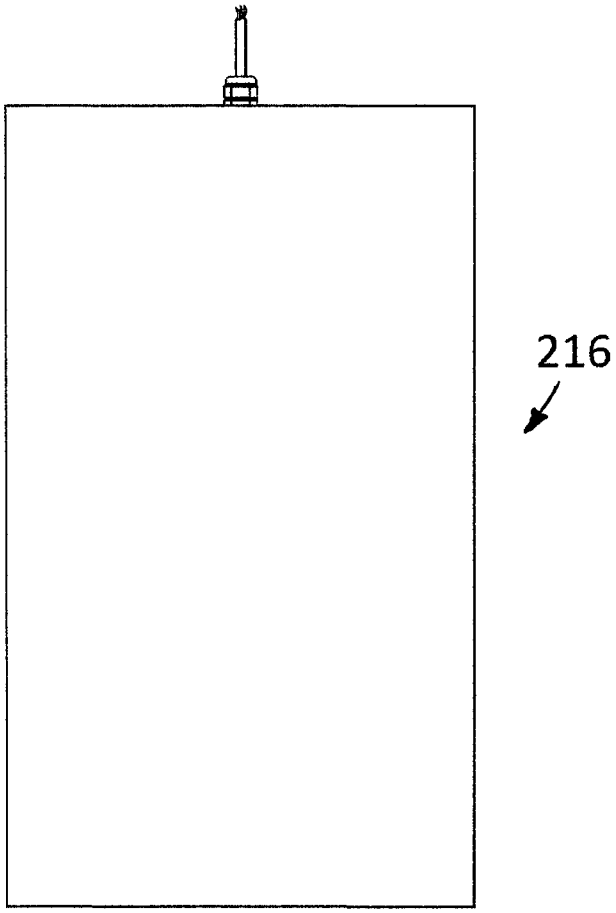
FIG. 14 is a perspective view of a squared cylinder type cladding connected to the interchangeable lighting assembly constructed according to the present disclosure.
Figure 15:
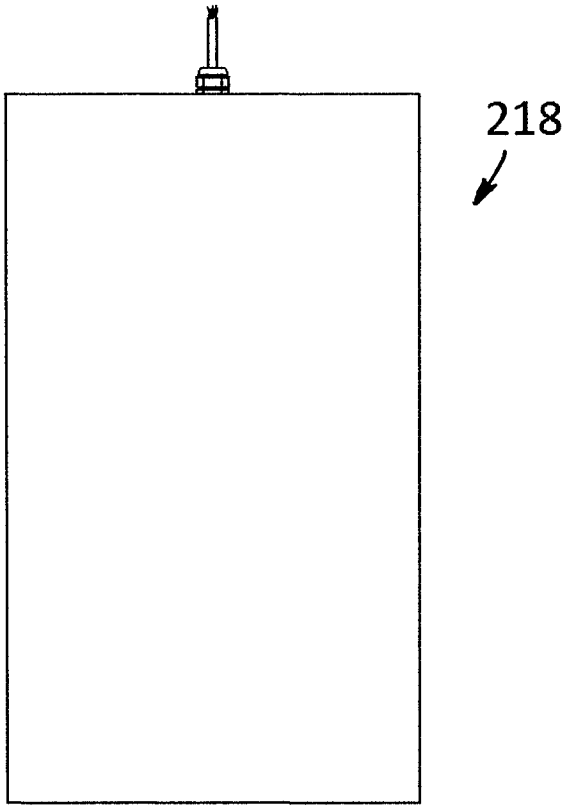
FIG. 15 is a perspective view of a squared rectangular type cladding connected to the interchangeable lighting assembly constructed according to the present disclosure.
Figure 16:
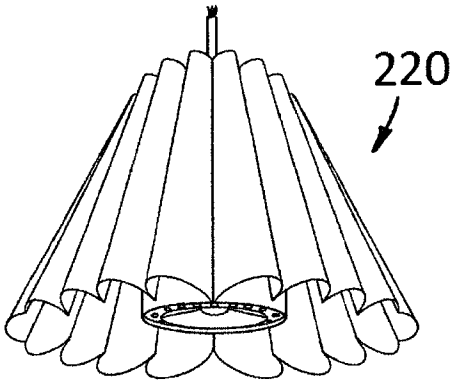
FIG. 16 is a perspective view of a fluted type cladding connected to the interchangeable lighting assembly constructed according to the present disclosure.
Figure 17:
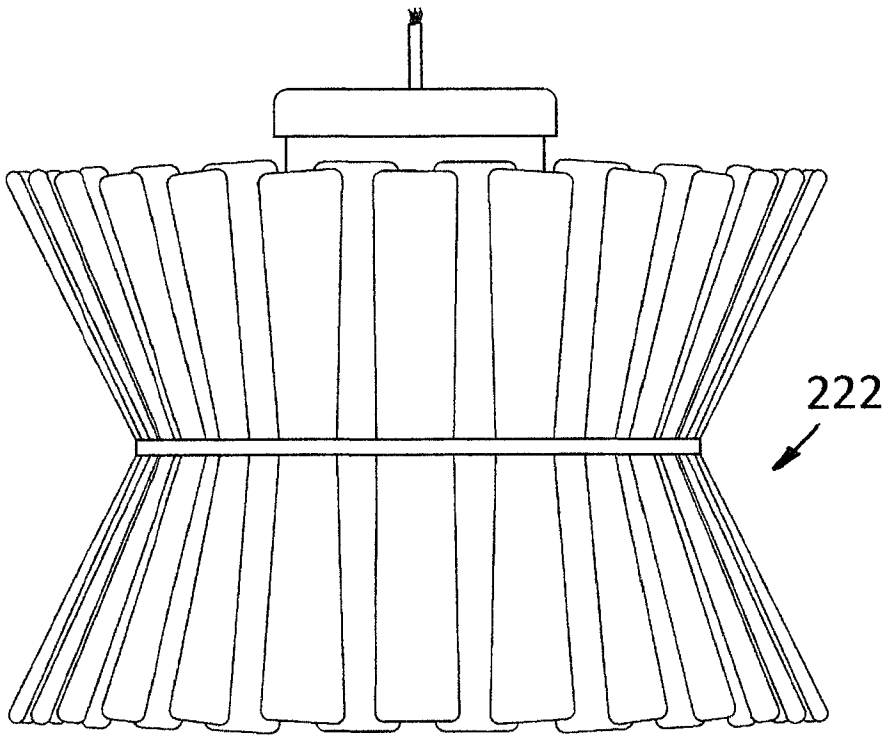
FIG. 17 is a perspective view of a double fluted type cladding connected to the interchangeable lighting assembly constructed according to the present disclosure.
Figure 18:
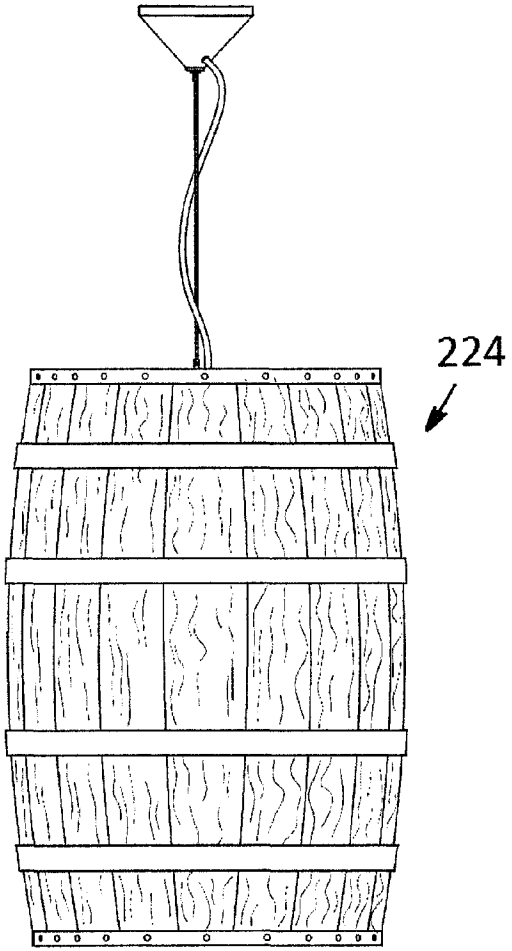
FIG. 18 is a perspective view of a whiskey barrel type cladding connected to the interchangeable lighting assembly constructed according to the present disclosure.

FIGS. 6-18 illustrated various interchangeable cladding members that may be used with the interchangeable lighting assemblies 10 and 150. In particular, FIG. 6 shows a basket type cladding member 200. FIG. 7 illustrates a cigar type cladding member 202. FIG. 8 depicts a vase type cladding member 204. FIG. 9 shows a diamond plate type cladding member 206. A globe type cladding member 208 is shown in FIG. 10. As can be appreciated, due to the configuration or size of the interchangeable cladding member, such as the globe type cladding member 208, it is possible that the cladding member 208 may require an internal structure to attach the cladding member 208 to the inner plate member 14 or 156. FIG. 11 illustrates a hat type cladding member 210. FIG. 12 depicts a flattened globe type cladding member 212. A truncated cone type cladding member 214 is illustrated in FIG. 13. FIG. 14 shows a squared cylinder type cladding member 216. A squared rectangular type cladding member 218 is illustrated in FIG. 15. In FIG. 16, a fluted type cladding member 220 is shown. FIG. 17 depicts a double fluted type cladding member 222. A whiskey barrel type cladding member 224 is shown in FIG. 18. As can be appreciated, any of the cladding members 200, 202, 204, 206, 208, 210, 212, 214, 216, 218, 220, or 224 may be used with the interchangeable light assemblies 10 and 150. There are numerous other cladding members that may be configured and constructed to be used in connection with the interchangeable light assemblies 10 and 150. For example, other cladding members may have various designs imprinted or incorporated into the cladding members, as may be desired.

Figure 19:
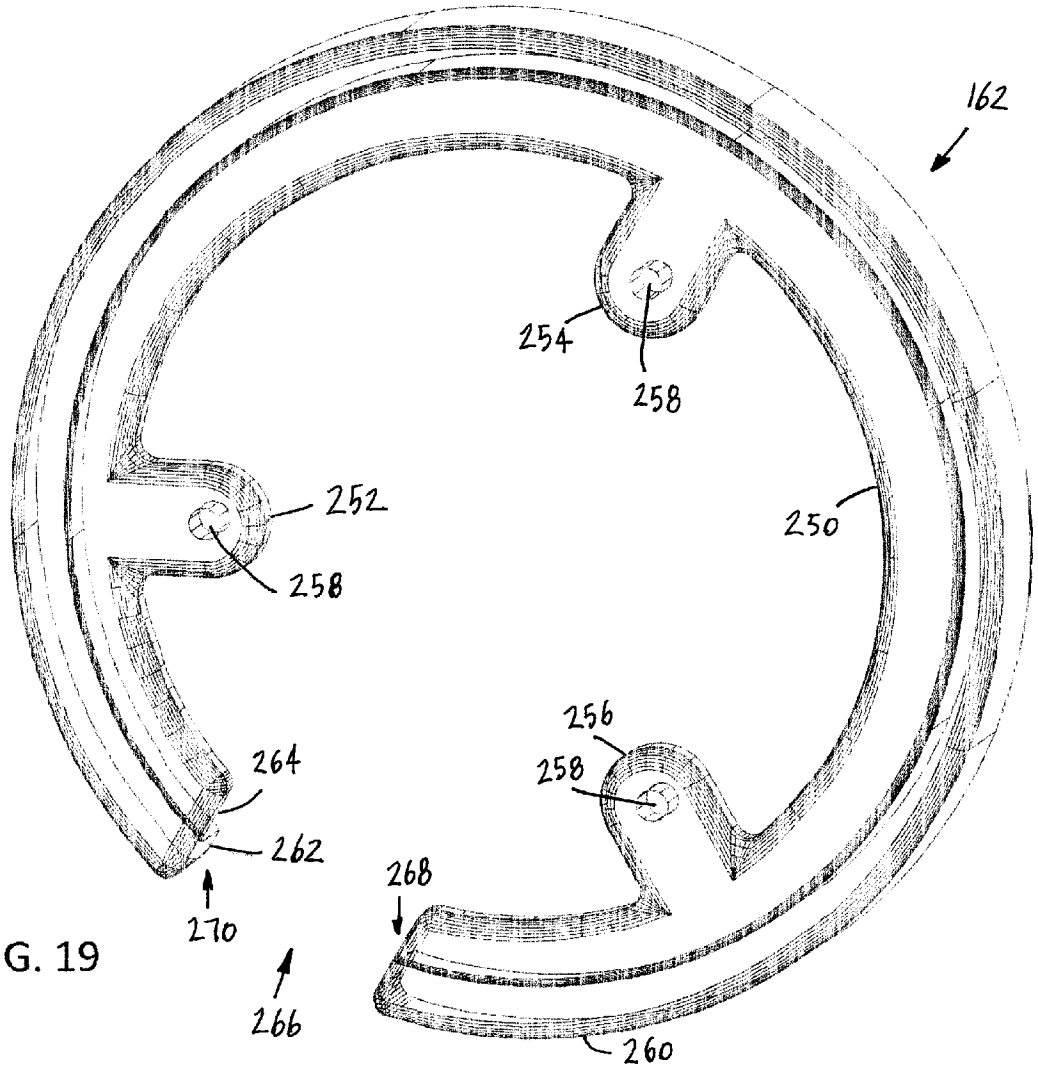
FIG. 19 is a top perspective view of an outer ring member constructed according to the present disclosure.

Referring now to FIG. 19, a top perspective view of the outer ring member 162 is shown. The outer ring member 162 comprises an inner radial surface 250 having three leg portions 252, 254, and 256 extending outwardly therefrom. Each of the leg portions 252, 254, and 256 has an aperture 258 for receiving a fastening device to connect the outer ring member 162 to the inner plate member 156 (FIG. 5). The outer ring member 162 has an outer radial surface 260 having a depending lip 262 and a side portion 264. The lip 262 is adapted for being placed along the outer cladding member 154 and the side portion 264 is for covering the tops of the inner cladding member 152 and the outer cladding member 154. The outer ring member 162 is generally C shaped and there is an opening 266 formed between a first end 268 and a second end 270.

From all that has been said, it will be clear that there has thus been shown and described herein an interchangeable lighting assembly which fulfills the various objects and advantages sought therefor. It will be apparent to those skilled in the art, however, that many changes, modifications, variations, and other uses and applications of the subject interchangeable lighting assembly are possible and contemplated. All changes, modifications, variations, and other uses and applications which do not depart from the spirit and scope of the disclosure are deemed to be covered by the disclosure, which is limited only by the claims which follow.

What is claimed is:

1. An interchangeable lighting assembly comprising:

an inner plate member having depending leg portions each having an aperture;

an interchangeable cladding member having an aperture that is aligned with one of the apertures of one of the depending leg portions of the inner plate member, the interchangeable cladding member fitting outside of the leg portions of the inner plate member;

a fastening device for securing the interchangeable cladding member to the inner plate member through the aperture of the interchangeable cladding member aligned with the aperture of the depending leg portion;

a plate member for fitting within the interchangeable cladding member;

a rod for connecting the plate member to the inner plate member; and a light source assembly connected to the plate member and depending therefrom.

2. The interchangeable lighting assembly of claim 1 further comprising a second rod for connecting the plate member to the inner plate member.

3. The interchangeable lighting assembly of claim 1 wherein the inner plate member further comprises a central opening through which a conduit is inserted.

4. The interchangeable lighting assembly of claim 1 wherein the rod comprises a threaded end and the inner plate member further comprises an aperture for receiving there through the threaded end of the rod.

5. The interchangeable lighting assembly of claim 1 wherein the interchangeable cladding member further comprises a second aperture that is aligned with another one of the apertures of one of the depending leg portions of the inner plate member.

6. The interchangeable lighting assembly of claim 1 further comprising a second interchangeable cladding member having an aperture that is aligned with one of the apertures of one of the depending leg portions, the second interchangeable cladding member for replacing the interchangeable cladding member.

7. The interchangeable lighting assembly of claim 1 wherein the inner plate member is triangular in shape.

8. An interchangeable lighting assembly comprising:

an inner plate member having depending leg portions each having an aperture;

an inner cladding member having apertures each aligned with each of the apertures of the leg portions, the inner cladding member fitting outside of the leg portions of the inner plate member;

an outer interchangeable cladding member having apertures each aligned with each of the apertures of the inner cladding member and each of the apertures of the leg portions, the outer interchangeable cladding member fitting outside of the inner cladding member;

a fastening device for insertion into each of the apertures of the outer interchangeable cladding member, the inner cladding member, and the depending leg portions for securing the outer interchangeable cladding member to the inner cladding member and the inner plate member;

an outer ring member connected to the inner plate member for capping the assembly;

a plate member for fitting within the inner cladding member;

a connecting member for connecting the plate member to the inner plate member; and a light source assembly connected to the plate member and depending therefrom.

9. The interchangeable lighting assembly of claim 8 wherein the connecting member comprises a rod having a threaded end.

10. The interchangeable lighting assembly of claim 8 wherein the inner plate member further comprises a central opening through which a conduit having wiring is inserted.

11. The interchangeable lighting assembly of claim 8 wherein the light source assembly comprises a heat sink assembly, a reflector, a lamp holder clamp member, and an LED light source.

12. The interchangeable lighting assembly of claim 8 further comprising a second outer interchangeable cladding member having apertures each aligned with each of the apertures of the inner cladding member and the leg portions, the second outer interchangeable cladding member for replacing the outer interchangeable cladding member, the outer interchangeable cladding member having a first configuration and the second outer interchangeable cladding member having a second configuration with the first configuration being different than the second configuration.

13. The interchangeable lighting assembly of claim 8 wherein the outer ring member comprises an inner radial surface having leg portions extending outwardly therefrom with each leg portion having an aperture for receiving a fastening device to connect the outer ring member to the inner plate member.

14. The interchangeable lighting assembly of claim 8 wherein the inner plate member is circular in shape having a central opening for receiving a conduit.

15. An interchangeable lighting assembly comprising:

an inner plate member having depending leg portions each having an aperture;

an interchangeable cladding member having apertures each aligned with each of the apertures of the leg portions;

a fastening device for insertion into each of the apertures of the interchangeable cladding member and the depending leg portions for securing the interchangeable cladding member to the inner plate member;

a plate member for fitting within the interchangeable cladding member;

a first rod and a second rod for connecting the plate member to the inner plate member; and a light source assembly connected to the plate member and depending therefrom.

16. The interchangeable lighting assembly of claim 15 wherein the first rod comprises a first threaded end and the second rod comprises a second threaded end and the inner plate member further comprises a first aperture and a second aperture with the first aperture for receiving there through the first threaded end of the first rod and the second aperture for receiving there through the second threaded end of the second rod.

17. The interchangeable lighting assembly of claim 15 further comprising a second interchangeable cladding member having apertures each aligned with each of the apertures of the leg portions, the second interchangeable cladding member for replacing the interchangeable cladding member, the interchangeable cladding member having a first configuration and the second interchangeable cladding member having a second configuration with the first configuration being different than the second configuration.

18. The interchangeable lighting assembly of claim 17 further comprising a third interchangeable cladding member having apertures each aligned with each of the apertures of the leg portions, the third interchangeable cladding member for replacing the second interchangeable cladding member with the third interchangeable cladding member having a third configuration with the third configuration being different than the second configuration of the second interchangeable cladding member.

19. The interchangeable lighting assembly of claim 18 further comprising a fourth interchangeable cladding member having apertures each aligned with each of the apertures of the leg portions, the fourth interchangeable cladding member for replacing the third interchangeable cladding member with the fourth interchangeable cladding member having a fourth configuration being different than the second configuration of the second interchangeable cladding member and the third configuration of the third interchangeable cladding member.

20. The interchangeable lighting assembly of claim 19 wherein the first configuration of the interchangeable cladding member is a cylinder type cladding member having perforations.

* * * * *